US010103453B2

(12) United States Patent
Pao et al.

(10) Patent No.: US 10,103,453 B2
(45) Date of Patent: Oct. 16, 2018

(54) CABLE CONNECTOR, CARRIER MODULE THEREOF, AND METHOD FOR ASSEMBLING THE SAME

(71) Applicant: TOPCONN ELECTRONIC (KUNSHAN) CO., LTD., Suzhou, Jiangsu Province (CN)

(72) Inventors: Chung-Nan Pao, New Taipei (TW); Yu-Hsiung Lin, New Taipei (TW); Yi-Guang Lai, New Taipei (TW); Ming-Chun Hsu, New Taipei (TW); Kai Wu, Guangdong (CN)

(73) Assignee: TOPCONN ELECTRONIC (KUNSHAN) CO., LTD, Suzhou, Jiangsu Province (CN)

( * ) Notice: Subject to any disclaimer, the term of this patent is extended or adjusted under 35 U.S.C. 154(b) by 126 days.

(21) Appl. No.: 15/239,244

(22) Filed: Aug. 17, 2016

(65) Prior Publication Data

US 2017/0294721 A1 Oct. 12, 2017

(30) Foreign Application Priority Data

Apr. 12, 2016 (CN) ..... 2016 2 0301560

(51) Int. Cl.
*H01R 12/24* (2006.01)
*H01R 4/02* (2006.01)
*H01R 12/72* (2011.01)

(52) U.S. Cl.
CPC ..... *H01R 4/023* (2013.01); *H01R 12/721* (2013.01)

(58) Field of Classification Search
CPC ..... H01R 12/598; H01R 9/0792
USPC ..... 439/497, 579
See application file for complete search history.

(56) References Cited

U.S. PATENT DOCUMENTS 5,810,620 A * 9/1998 Kobayashi ..... A61B 1/00114 392/379
5,964,620 A * 10/1999 Takahashi ..... H01R 9/0518 439/579
6,338,652 B1 * 1/2002 Ko ..... H01R 9/0515 439/497
6,869,308 B2 * 3/2005 Wu ..... H01R 12/62 439/497
6,913,485 B2 * 7/2005 Ko ..... H01R 9/035 439/579

(Continued)

*Primary Examiner* — Neil Abrams
(74) *Attorney, Agent, or Firm* — Li & Cai Intellectual Property (USA) Office

(57) ABSTRACT

A carrier module of a cable connector includes a circuit board and a grounding bar disposed on the circuit board. The circuit board includes a first insulating layer, a second insulating layer, and a grounding layer arranged between the first and second insulating layers. The circuit board has a hole formed on a surface thereof and a conductive extension disposed within the hole, and the conductive extension is connected to the grounding layer. The grounding bar includes a base portion and a conductive portion connected to the base portion. The conductive portion is inserted into the hole, and connected to the conductive extension, thereby electrically connecting the grounding bar and the grounding layer of the circuit board. Thus, the carrier module of the instant disclosure is provided with the grounding bar having well grounding performance which is firmly fixed on the circuit board.

14 Claims, 17 Drawing Sheets

(56) References Cited

U.S. PATENT DOCUMENTS

| | | | | |
|---|---|---|---|---|
| 6,939,174 | B2 * | 9/2005 | Wu | H01R 13/514 439/607.05 |
| 7,118,409 | B2 * | 10/2006 | Kuroda | H01R 23/661 439/497 |
| 7,510,425 | B2 * | 3/2009 | Kuo | H05K 3/3405 439/493 |
| 7,819,675 | B2 * | 10/2010 | Ko | H01R 9/034 439/98 |
| 8,011,950 | B2 * | 9/2011 | McGrath | H01R 12/594 439/497 |
| 8,900,007 | B2 * | 12/2014 | Nonen | H01R 9/037 439/497 |
| 9,041,414 | B2 * | 5/2015 | Nonen | G01R 1/0408 324/613 |
| 9,203,193 | B2 * | 12/2015 | Hackman | H01R 13/648 |
| 9,276,330 | B2 * | 3/2016 | Wu | H01R 12/775 |
| 9,306,334 | B2 * | 4/2016 | Zhu | H05K 1/0219 |
| 9,373,915 | B1 * | 6/2016 | Schulz | H01R 13/6594 |
| 9,431,729 | B2 * | 8/2016 | Kondo | H01R 9/034 |
| 9,437,981 | B2 * | 9/2016 | Wu | H01R 4/023 |
| 9,466,925 | B2 * | 10/2016 | Rost | H01R 9/032 |
| 9,660,369 | B2 * | 5/2017 | Lee | H01R 12/778 |
| 9,705,273 | B2 * | 7/2017 | Guetig | H01R 43/16 |
| 9,728,912 | B2 * | 8/2017 | Kasturi | H01R 24/50 |
| 9,774,113 | B2 * | 9/2017 | Zhang | H01R 12/594 |
| 2011/0306244 | A1 * | 12/2011 | Zhang | H01R 9/034 439/624 |
| 2017/0294721 | A1 * | 10/2017 | Pao | H01R 12/721 |

* cited by examiner

2

CABLE CONNECTOR, CARRIER MODULE THEREOF, AND METHOD FOR ASSEMBLING THE SAME

BACKGROUND OF THE INVENTION

1. Field of the Invention

The instant invention relates to a connector, in particular, to a cable connector, a carrier module thereof, and a method for assembling the cable connector.

2. Description of Related Art

The conventional cable connector includes a circuit board, a plurality of cables, and a positioning member. One end of each cable is welded on a surface of the circuit board, and an edge of the positioning member is welded on the surface of the circuit board to press the cables, such that the cables are clamped by the circuit board and the positioning member.

However, the edge of the positioning member is fixed on the surface of the circuit board by using spot welding, so the connection between the positioning member and the circuit board is unstable. Accordingly, when any cable and the circuit board are pulled to generate a shearing force, the positioning member is easily separated from the surface of the circuit board because of the shearing force. Moreover, a portion of the positioning member welded on the surface of the circuit board is not electrically connected to a grounding layer embedded in the circuit board, so the positioning member and the grounding layer cannot establish a common-grounding loop. Thus, there is still a room for improvement in regard to the high frequency transmitting performance of the conventional cable connector.

SUMMARY OF THE INVENTION

The instant disclosure provides a cable connector, a carrier module thereof, and a method for assembling the cable connector for effectively solving the deficiency and shortcoming of the conventional cable connector.

The instant disclosure provides a cable connector, comprising: a circuit board having a first insulating layer, a second insulating layer, and a grounding layer arranged between the first insulating layer and the second insulating layer, wherein two opposite outer surfaces of the circuit board are defined as a first surface and a second surface, the circuit board has at least one hole formed on the first surface, and the circuit board has at least one conductive extension arranged in the hole and connected to the grounding layer; a plurality of conductive cables, each comprising: a metallic wire having an exposed segment and an embedded segment; an isolation layer covering the embedded segment; and a metallic shielding layer covering the isolation layer, wherein the exposed segment is arranged out of the isolation layer and the metallic shielding layer, wherein the conductive cables are positioned on the first surface of the circuit board, and the exposed segments of the conductive cables are fixed on the first surface of the circuit board; and a grounding bar, comprising: a base portion abutting against the metallic shielding layers of the conductive cables, and the metallic shielding layers are electrically connected to each other via the base portion; and at least one conductive portion connected to the base portion and inserted into the hole of the circuit board, wherein the conductive portion is connected to the conductive extension, so the grounding bar is configured to electrically connect the metallic shielding layers of the conductive cables and the grounding layer of the circuit board.

Preferably, the base portion of the grounding bar includes a beam and a plurality of positioning arms connected to the beam, the conductive portion is connected to the beam, and the positioning arms are respectively connected to the metallic shielding layers.

The instant disclosure also provides a method for assembling the above cable connector, comprising: a) inserting the conductive portion of the grounding bar into the hole of the circuit board to connect the conductive extension, and disposing the beam on the first insulating layer of the circuit board; b) disposing the conductive cables on the first surface of the circuit board and the beam respectively adjacent to the positioning arms; c) welding the exposed segments of the conductive cables on the first surface of the circuit board; and d) fixing the positioning arms respectively on the metallic shielding layers of the conductive cables.

The instant disclosure further provides a carrier module of a cable connector, comprising: a circuit board having a first insulating layer, a second insulating layer, and a grounding layer arranged between the first insulating layer and the second insulating layer, wherein two opposite outer surfaces of the circuit board are defined as a first surface and a second surface, the circuit board has at least one hole formed on the first surface, and the circuit board has at least one conductive extension arranged in the hole and connected to the grounding layer; and a grounding bar, comprising: a base portion; and at least one conductive portion connected to the base portion and inserted into the hole of the circuit board, wherein the conductive portion is connected to the conductive extension, so the grounding bar is configured to electrically connect the grounding layer of the circuit board.

In summary, each grounding bar of the cable connector (or the carrier module) in the instant disclosure is firmly fixed on the circuit board by inserting the conductive portions into the circuit board, so the connection of the circuit board and the each grounding bar can effectively resist a shearing force when any conductive cable and the circuit board are pulled. Moreover, the metallic shielding layers of the conductive cables, the grounding bars, and the grounding layer of the circuit board can establish a common-grounding loop to improve the high frequency transmitting performance of the cable connector.

In addition, the construction of the cable connector and the method disclosed is provided for installing the grounding bars on the circuit board and then disposing the conductive cables adjacent to the positioning arms of the grounding bars, so that the cable connector and the method of the instant disclosure can provide a better positioning effect for the conductive cables.

In order to further appreciate the characteristics and technical contents of the instant invention, references are hereunder made to the detailed descriptions and appended drawings in connection with the instant invention. However, the appended drawings are merely shown for exemplary purposes, rather than being used to restrict the scope of the instant invention.

DETAILED DESCRIPTION OF THE PREFERRED EMBODIMENTS

First Embodiment

Figure 1:
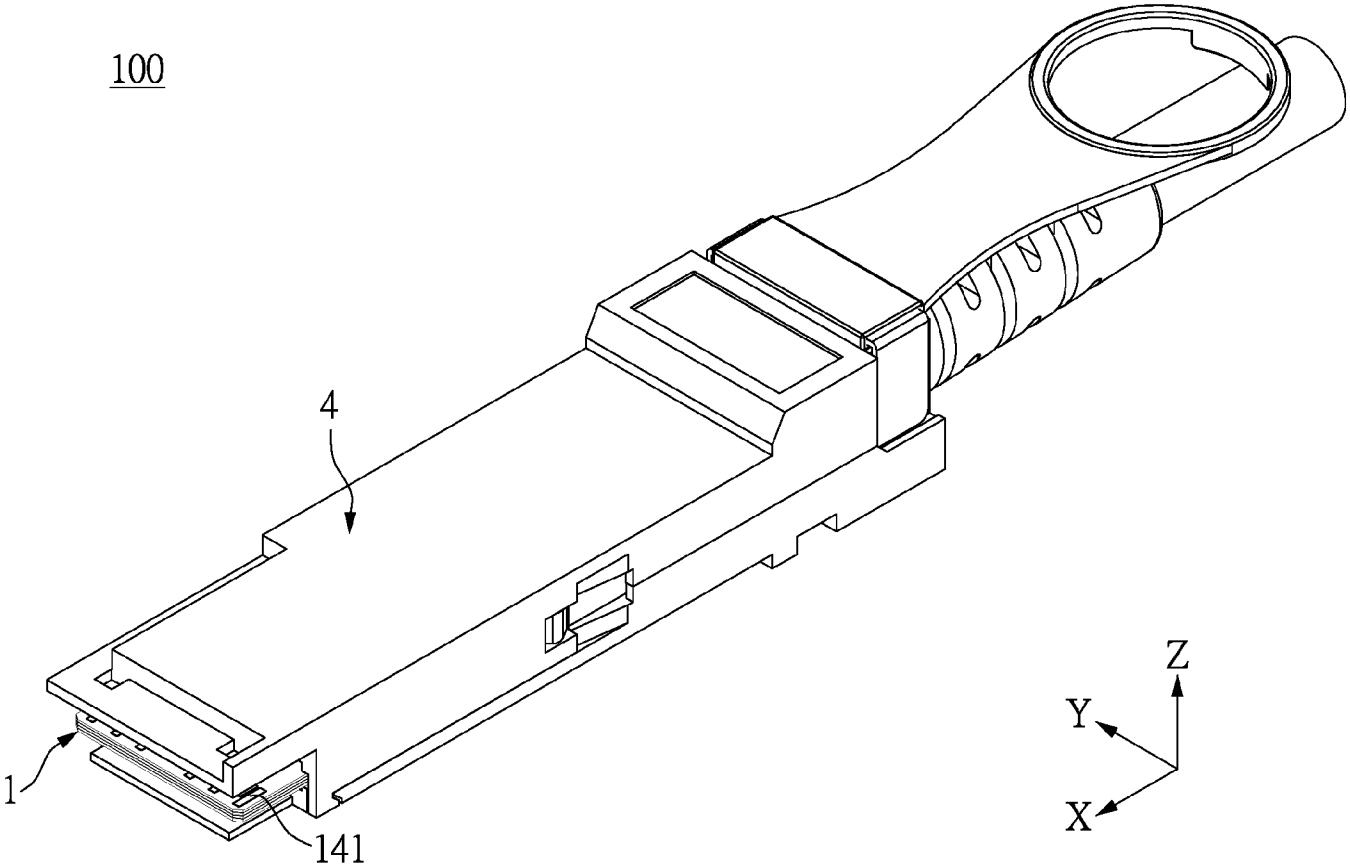
FIG. 1 is a perspective view showing a cable connector according to a first embodiment of the instant disclosure.

Please refer to FIGS. 1 through 11, which show a first embodiment of the instant disclosure. References are hereunder made to the detailed descriptions and appended drawings in connection with the instant invention. However, the appended drawings are merely shown for exemplary purposes, rather than being used to restrict the scope of the instant invention.

Please refer to FIGS. 1 through 4, which show a cable connector 100 of the instant embodiment including a circuit board 1, two grounding bars 2, a plurality of conductive cables 3, and a housing 4 receiving the circuit board 1, the grounding bars 2, and part of each conductive cable 3. A front end portion of the circuit board 1 is exposed from the housing 4. The conductive cables 3 are positioned on a rear end portion of the circuit board 1 by using the grounding bars 2.

FIGS. 2 through 11 do not show the housing 4 in order to more clearly show the inner construction of the cable connector 100, and each figure shows an axis X, an axis Y, and an axis Z, which are perpendicular to each other, to easily present the relative position and direction of the elements of the cable connector 100. In the instant embodiment, the axis X is parallel to a length direction of the circuit board 1, the axis Y is parallel to a width direction of the circuit board 1, and the axis Z is parallel to a thickness direction of the circuit board 1.

Figure 2:
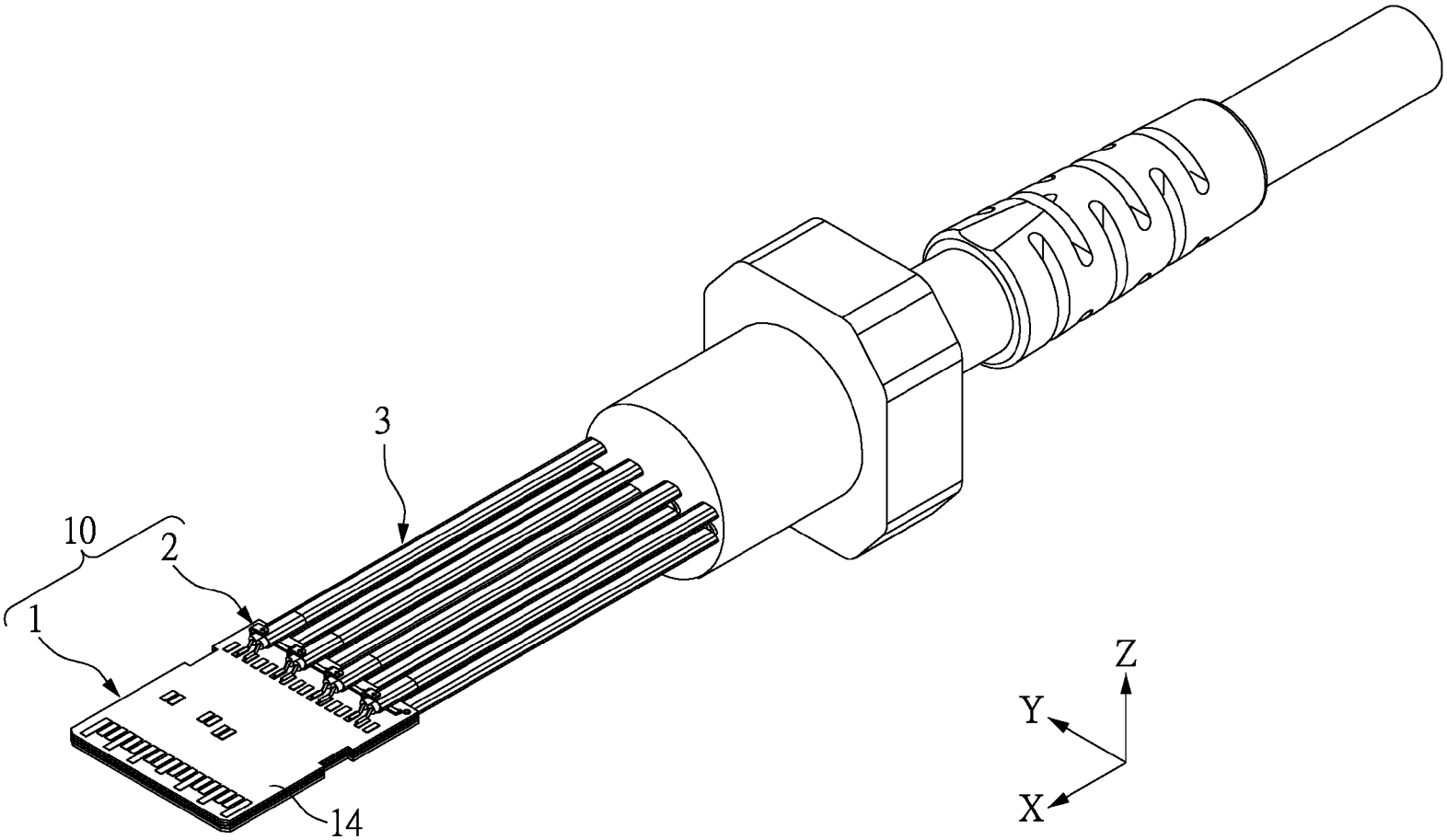
FIG. 2 is a perspective view of FIG. 1 as the housing is omitted.

It should be noted that the circuit board 1 and at least one of the grounding bars 2 can be defined as a carrier module 10 of the cable connector 100 (as shown in FIG. 2) and are configured to clamp and position the conductive cables 3. Moreover, the cable connector 100 in the instant embodiment includes the two grounding bars 2 and the corresponding conductive cables 3, but the instant disclosure is not limited thereto. For example, in a non-shown embodiment, the cable connector 100 can be provided with one grounding bar 2 and the corresponding conductive cables 3.

Figure 3:
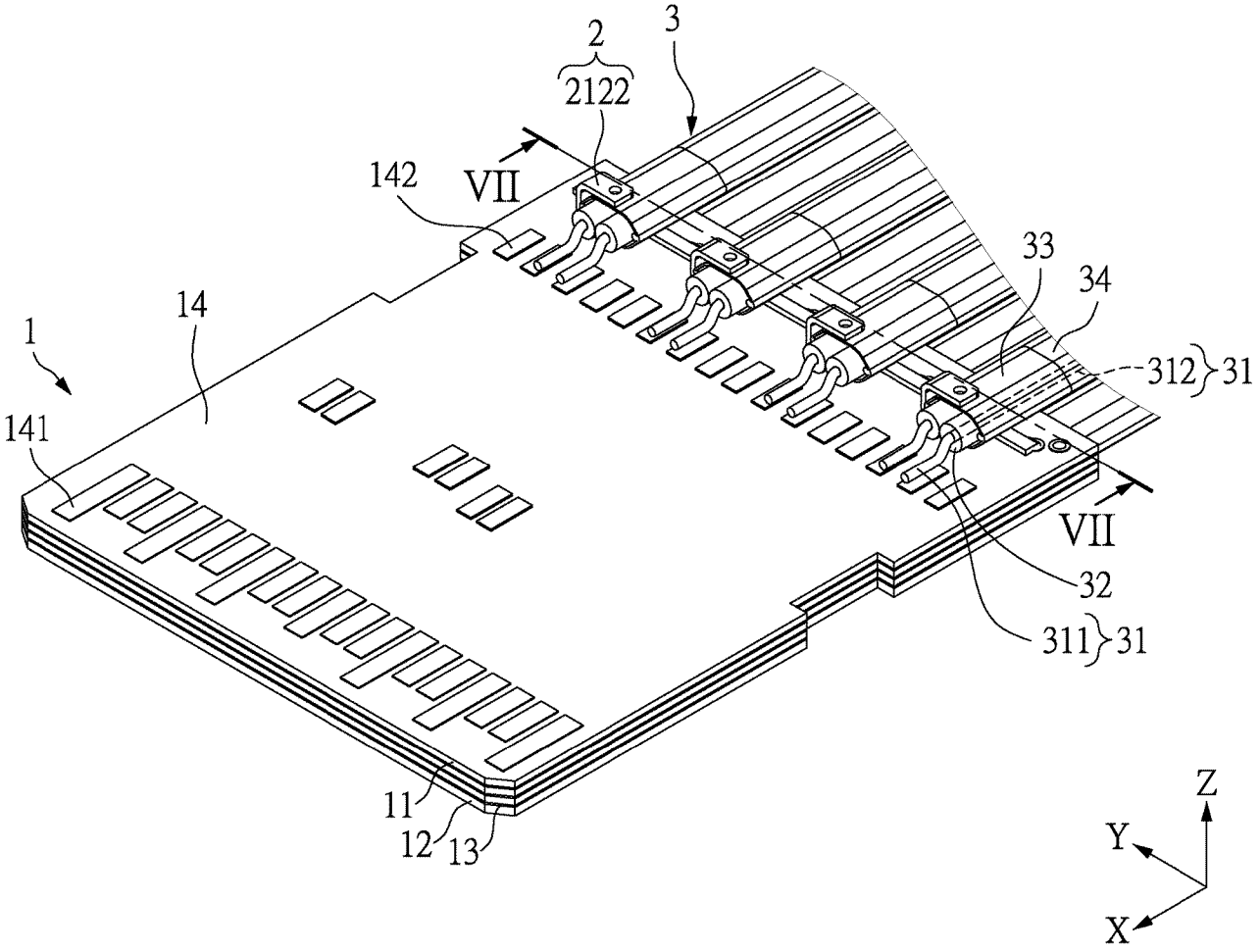
FIG. 3 is an enlarged view of FIG. 2.
Figure 4:
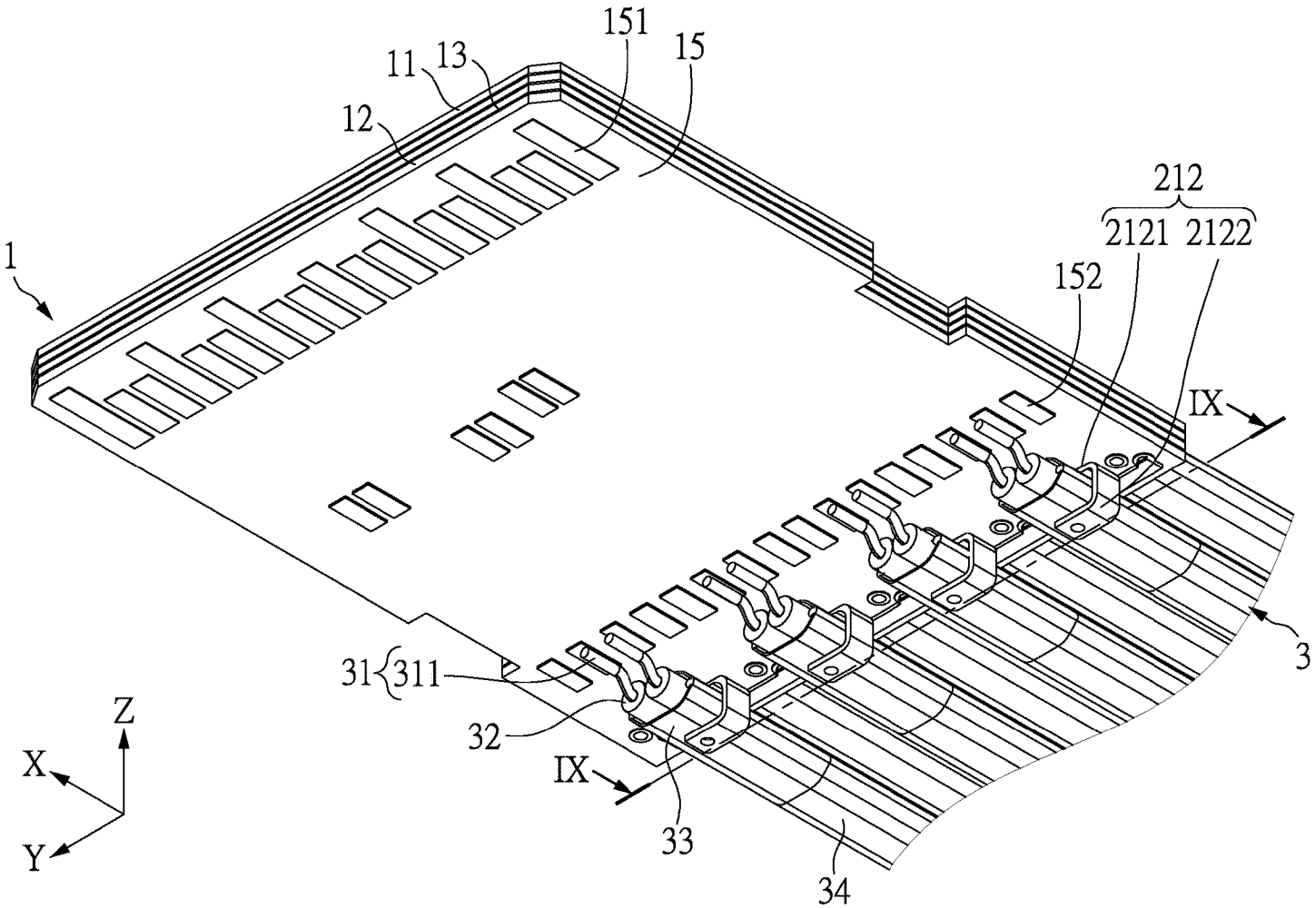
FIG. 4 is an enlarged view of FIG. 2 from another perspective.

As shown in FIGS. 3 and 4, the circuit board 1 having a rectangular shape includes a first insulating layer 11, a second insulating layer 12, and at least one grounding layer 13 arranged between the first insulating layer 11 and the second insulating layer 12. Two opposite outer surfaces of the circuit board 1 along the axis Z are defined as a first surface 14 and a second surface 15, and the first surface 14 and the second surface 15 are respectively the top surface of the circuit board 1 shown in FIG. 3 and the bottom surface of the circuit board 1 shown in FIG. 4.

Each of the first surface 14 and the second surface 15 has a plurality of contacting pads 141, 151 arranged in a row that is parallel to the axis Y. The contacting pads 141, 151 are arranged adjacent to the front edge of the circuit board 1 for electrically connecting to a mating connector (not shown), which is inserted into the cable connector 100. Each of the first surface 14 and the second surface 15 has a plurality of welding pads 142, 152 arranged in a row that is parallel to the axis Y. The welding pads 142, 152 are arranged adjacent to the rear edge of the circuit board 1 for connecting to the conductive cables 3 by welding. In addition, the welding pads 142, 152 in the instant embodiment are arranged in equidistant, but the arrangement and number of the welding pads 142, 152 can be adjusted according to the conductive cables 3.

Specifically, the first surface 14 in the instant embodiment includes the outer surface of the first insulating layer 11, the contacting pads 141, and the welding pads 142. The second surface 15 in the instant embodiment includes the outer surface of the second insulating layer 12, the contacting pads 151, and the welding pads 152. Moreover, the welding pads 142, 152 connected to the conductive cables 3 are respectively and electrically connected to the contacting pads 141, 151 by at least one circuit layer (not shown) embedded in the circuit board 1, so that the conductive cables 3 can transmit signal or power to the mating connector by using the circuit board 1.

Figure 5:
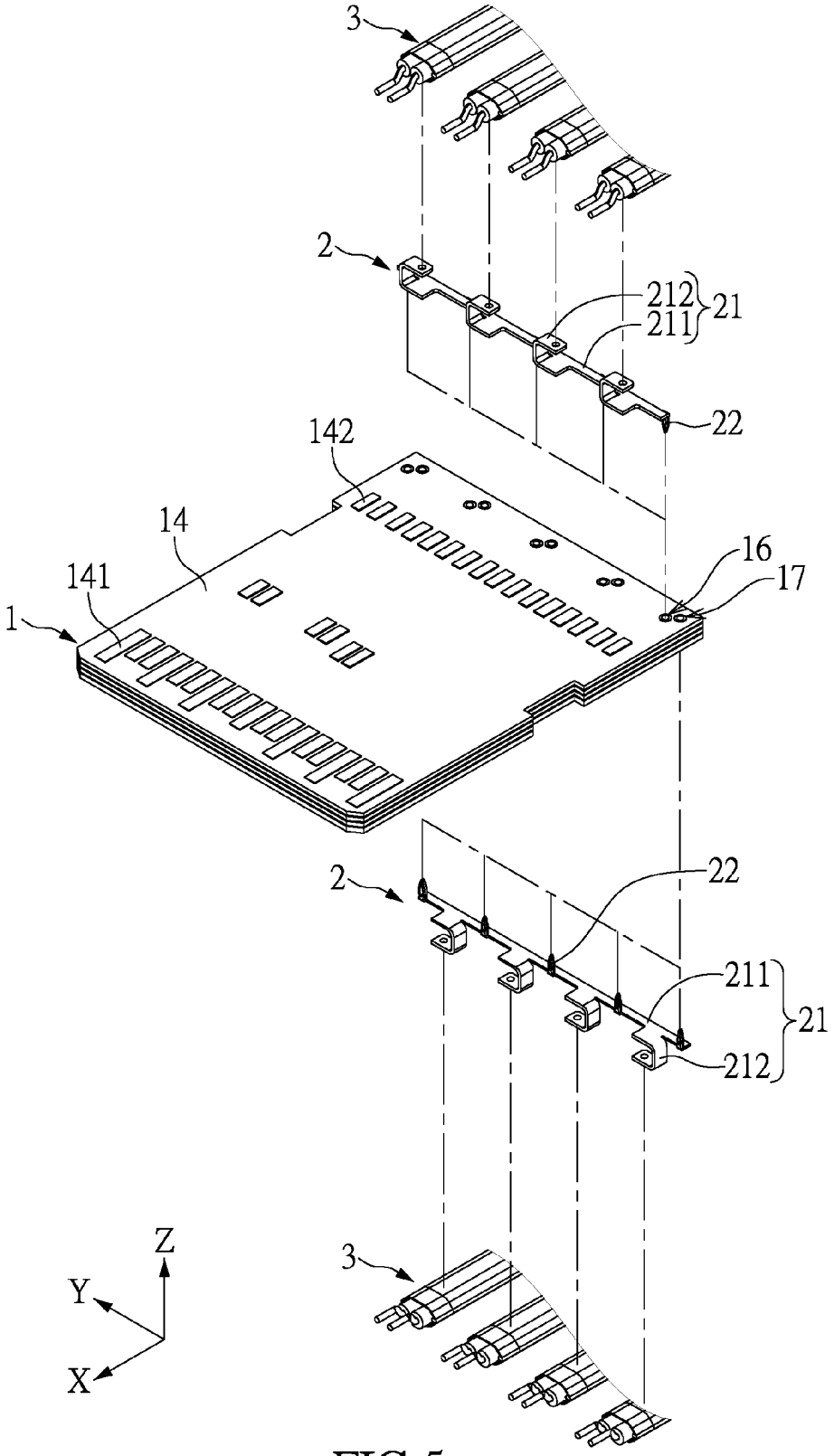
FIG. 5 is an exploded view of FIG. 3.
Figure 6:
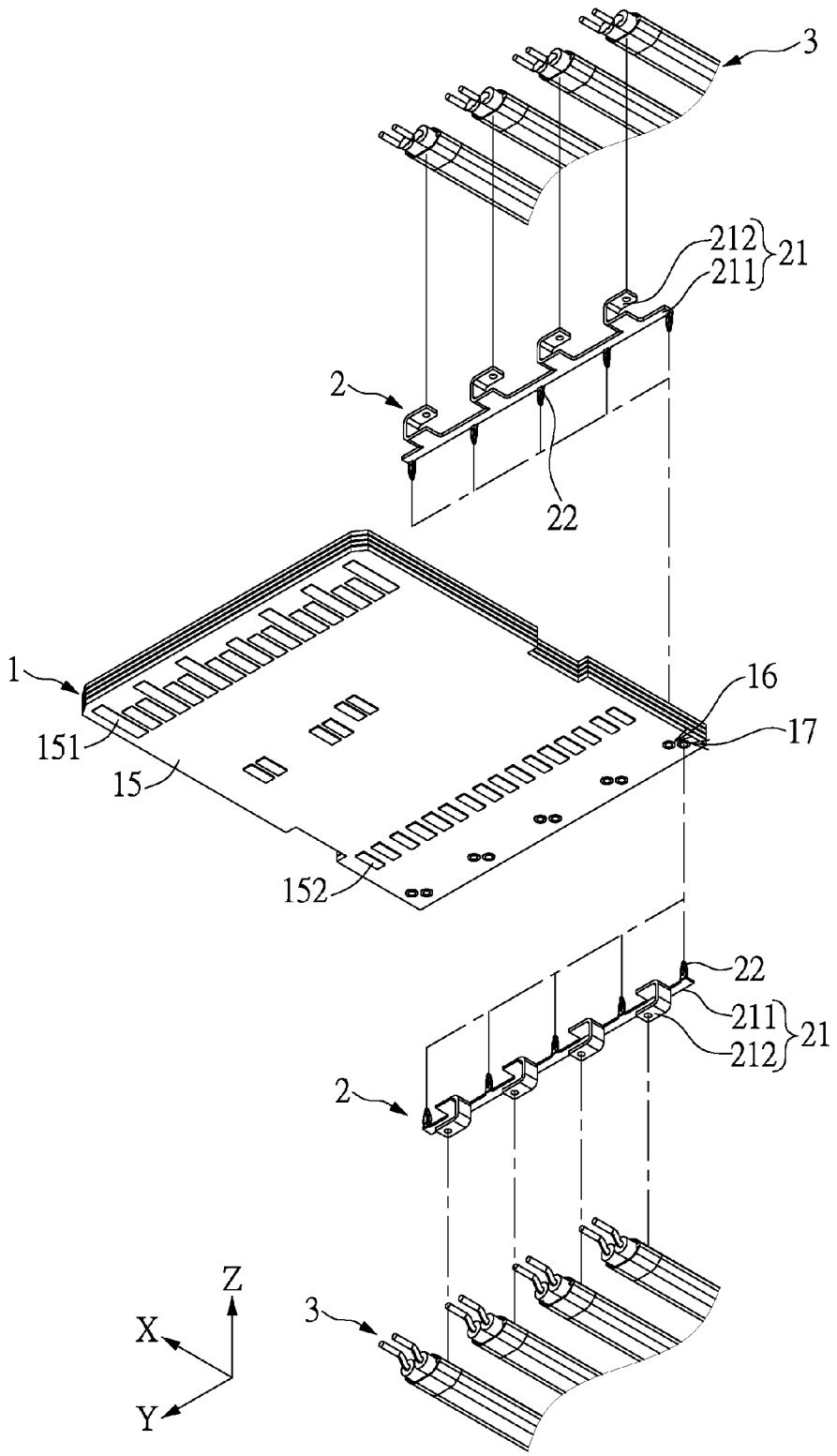
FIG. 6 is an exploded view of FIG. 4.
Figure 7:
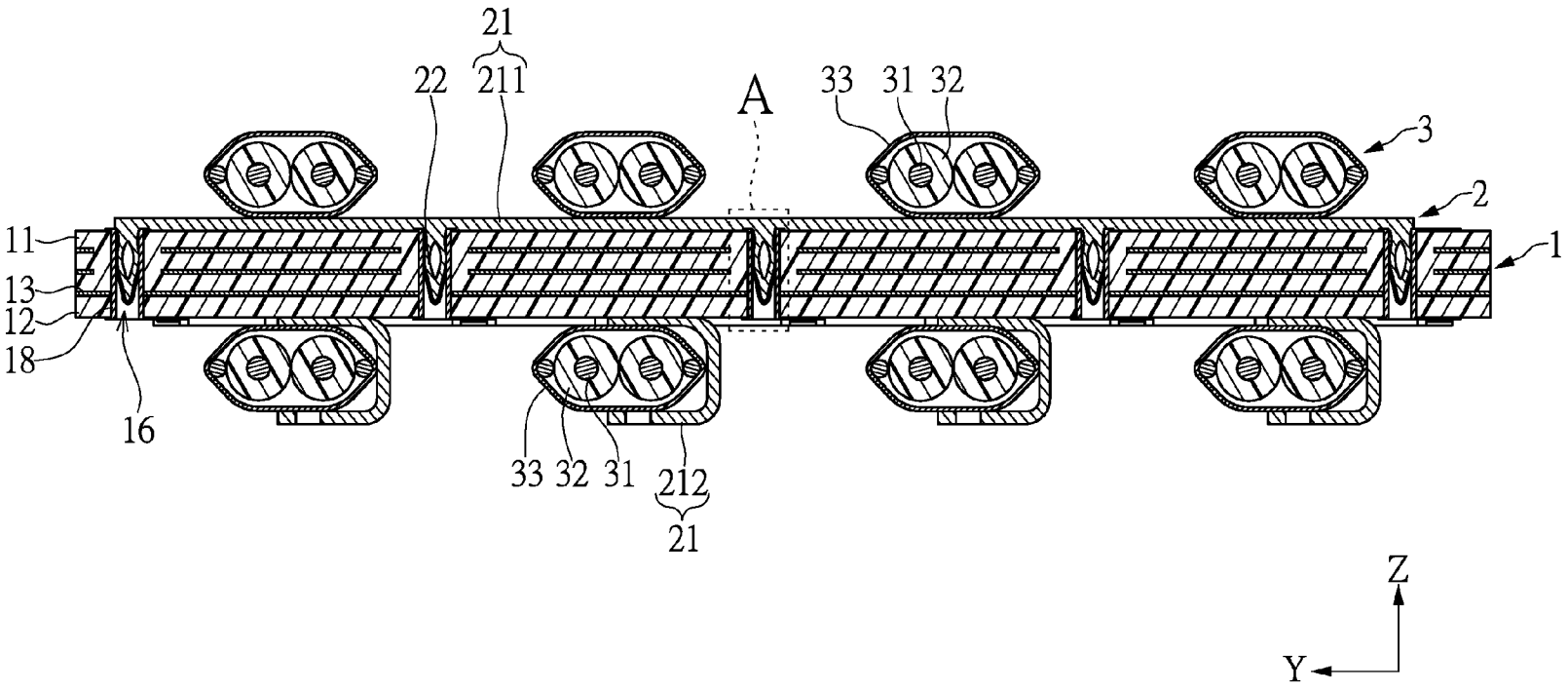
FIG. 7 is a cross-sectional view of FIG. 3 along a cross-sectional line VII-VII.
Figure 8:
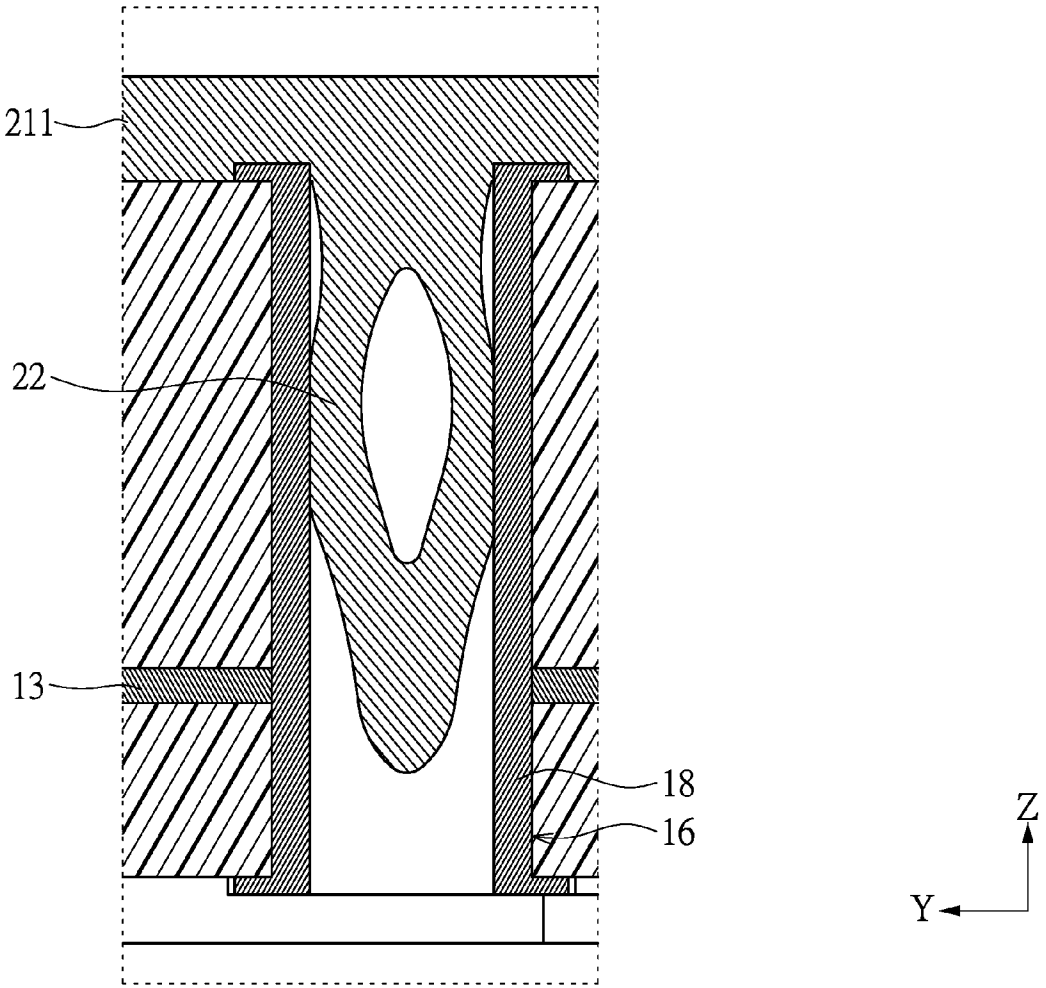
FIG. 8 is an enlarged view showing a portion A of FIG. 7.
Figure 9:
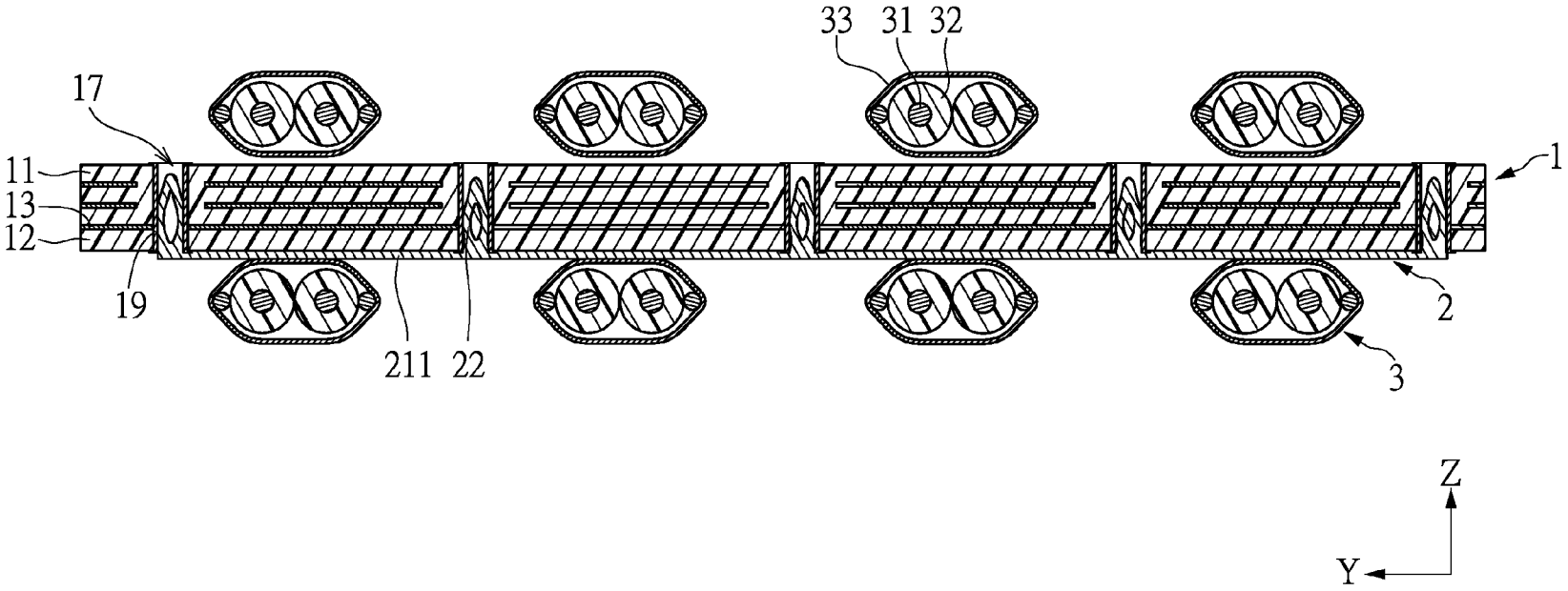
FIG. 9 is a cross-sectional view of FIG. 4 along a cross-sectional line IX-IX.

As shown in FIGS. 5 and 6, a plurality of first holes 16 are inwardly formed on the first surface 14 of the circuit board 1, and a plurality of second holes 17 are inwardly formed on the second surface 15 of the circuit board 1. The circuit board 1 has a plurality of first conductive extensions 18 (as shown in FIGS. 7 and 8) respectively arranged in the first holes 16 and connected to the grounding layer 13, and the circuit board 1 also has a plurality of second conductive extensions 19 (as shown in FIG. 9) respectively arranged in the second holes 17 and connected to the grounding layer 13.

Specifically, the first holes 16 and the second holes 17 in the instant embodiment are arranged in two rows that are parallel to the Y axis and are arranged between the row of the welding pads 142 and the rear edge of the circuit board 1. Each first hole 16 in the instant embodiment is formed to penetrate the first surface 14 and the second surface 15, and each second hole 17 in the instant embodiment is also formed to penetrate the first surface 14 and the second surface 15. The first conductive extensions 18 are respectively coated on the inner walls for defining the first holes 16, and the second conductive extensions 19 are respectively coated on the inner walls for defining the second holes 17, but the instant disclosure is not limited thereto. For example, in a non-shown embodiment, the first hole 16 and/or the second hole 17 can be a blind hole.

It should be noted that each one of the first hole 16 and the second hole 17 can be regarded simply as a hole because the terms "first" and "second" are only used to distinguish the two holes for easily understanding the instant embodiment. For the same reason, each one of the first conductive extension 18 and the second conductive extension 19 can be regarded simply as a conductive extension.

Moreover, the number of the first holes 16, the second holes 17, the first conductive extensions 18, or the second conductive extensions 19 of the circuit board 1 in the instant embodiment is plural, but the instant disclosure is not limited thereto. For example, in a non-shown embodiment, the number of the first hole 16, the second hole 17, the first conductive extension 18, or the second conductive extension 19 of the circuit board 1 can be only one. The circuit board 1 can be provided with a plurality of grounding layers 13.

As shown in FIGS. 5 and 6, the two grounding bars 2 are substantially the same, so this paragraph discloses the construction of one grounding bar 2. The grounding bar 2 in the instant embodiment is integrally formed and is made of an electrically conductive material (e.g., copper). The grounding bar 2 includes a base portion 21 and a plurality of conductive portions 22 connected to the base portion 21. The base portion 21 of the grounding bar 2 includes a beam 211 and a plurality of positioning arms 212 connected to the beam 211. The conductive portions 22 are connected to the beam 211, and a portion of the beam 211 arranged between any two adjacent conductive portions 22 extends to form one positioning arm 212. Each positioning arm 212 in the instant embodiment has a hook-like construction.

In addition, the number of the conductive portions 22 of each grounding bar 2 in the instant embodiment is plural, but the instant disclosure is not limited thereto. For example, in a non-shown embodiment, the number of the conductive portion 22 of each grounding bar 2 can be only one.

As shown in FIGS. 5 and 7, the beams 211 of the two grounding bars 2 are respectively disposed on the first insulating layer 11 (or the first surface 14) and the second insulating layer 12 (or the second surface 15) of the circuit board 1. As shown in FIGS. 7 through 9, the conductive portions 22 of one of the grounding bars 2 are respectively inserted into the first holes 16 of the circuit board 1 and are respectively abutted against the first conductive extensions 18, and the conductive portions 22 of the other grounding bar 2 are respectively inserted into the second holes 17 of the circuit board and are respectively abutted against the second conductive extensions 19. Specifically, each conductive portion 22 having a press-fit pin is inserted into the corresponding first hole 16 (or the corresponding second hole 17) and is compressed against the corresponding first conductive extension 18 (or the corresponding second conductive extension 19). That is to say, a width of each conductive portion 22 in the instant embodiment is greater than that of each first hole 16 (or each second hole 17), but the instant disclosure is not limited thereto.

For example, in a non-shown embodiment, the width of each conductive portion 22 can be less than that of each first hole 16 (or each second hole 17). Specifically, after the conductive portion 22 is inserted into the first hole 16 (or the second hole 17), the first hole 16 (or the second hole 17) is filled with a conductive material and then the conductive material is solidified to form the first conductive extension 18 (or the second conductive extension 19), such that the conductive portion 22 is connected to the first conductive extension 18 (or the second conductive extension 19). Additionally, in a non-shown embodiment, the conductive portions 22 of the grounding bar 2 can be disposed selectively with distinct widths.

Accordingly, the two grounding bars 2 are electrically connected to the grounding layer 13 of the circuit board 1 by using conductive portions 22 to connect the first conductive extensions 18 and the second conductive extensions 19. Moreover, each grounding bar 2 in the instant embodiment is fixed on the circuit board 1 by inserting the conductive portions 22 into the first holes 16 (or the second holes 17) of the circuit board 1, so that the connection of the circuit board 1 and each grounding bar 2 can effectively resist a shearing force when any of the conductive cables 3 or the circuit board 1 are pulled. Each grounding bar 2 in the instant embodiment can be configured, without welding, to each of the first surface 14 and the second surface 15 of the circuit board 1. That is to say, the grounding bar 2 can also be provided for selectively welding to the welding pads 142, 152 of the circuit board 1 according to the designer's demand, but the conventional positioning members are fixed on the circuit board only by welding.

Please refer to FIGS. 3, 4, 7, and 9. The conductive cables 3 are substantially the same, so this paragraph discloses one of the conductive cables 3 as an example. The conductive cable 3 includes two metallic wires 31, two isolation layers 32, a metallic shielding layer 33, and an insulation layer 34. Each metallic wire 31 has an exposed segment 311 and an embedded segment 312 (as shown in FIG. 3), and the isolation layers 32 are made of an insulating material and cover the embedded segments 312 of the two metallic wires 31 to separate the two metallic wires 31 from each other. The metallic shielding layer 33 covers the isolation layers 32. The exposed segments 311 of the two metallic wires 31 are arranged out of the isolation layers 32 and the metallic shielding layer 33. The insulation layer 34 covers part of the metallic shielding layer 33, in other words, the insulation layer 34 does not cover the portion of the metallic shielding layer 33 near to the exposed segments 311.

In addition, each conductive cable 3 in the instant embodiment has two metallic wires 31, and each metallic wire 31 is a single core wire, but the instant disclosure is not limited thereto. For example, in a non-shown embodiment, each conductive cable 3 could be provided with only one metallic wire 31 or three or more metallic wires 31, and each metallic wire 31 can be a multi-core wire. Each metallic wire 31 and each metallic shielding layer 33 in the instant embodiment can be made of copper, aluminum, or other conductive material. Each isolation layer 32 and each insulation layer 34 in the instant embodiment can be made of PolyVinyl Chloride (PVC), Polyethylene (PE), rubber, or other insulating material.

The conductive cables 3 are respectively positioned on the first surface 14 and the second surface 15 of the circuit board 1, and the exposed segments 311 are respectively welded on the welding pads 142 of the first surface 14 and the welding pads 152 of the second surface 15. Moreover, the base portions 21 of the two grounding bars 2 respectively abut against the metallic shielding layers 33 of the conductive cables 3, and the positioning arms 212 are respectively connected to the metallic shielding layers 33, so the metallic shielding layers 33 are electrically connected to each other by using the base portion 21, and the grounding bars 2 are configured to electrically connect the metallic shielding layers 33 of the conductive cables 3 and the grounding layer 13 of the circuit board 1. Accordingly, the conductive cables 3 are firmly fixed on the circuit board 1 by using the two grounding bars 2, and the metallic shielding layers 33, the two grounding bars 2, and the grounding layer 13 can establish a common-grounding loop to improve the high frequency transmitting performance of the cable connector 100.

In addition, as shown in FIGS. 10, 11, 3, and 4, the instant embodiment also provides a method for assembling the cable connector 100. The method in the following description discloses how to assemble the two grounding bars 2 onto the circuit board 1, but is not limited thereto. For example, the method can be applied to assemble one grounding bar 2 onto the circuit board 1. The method of the instant embodiment is disclosed as follows.

Figure 10:
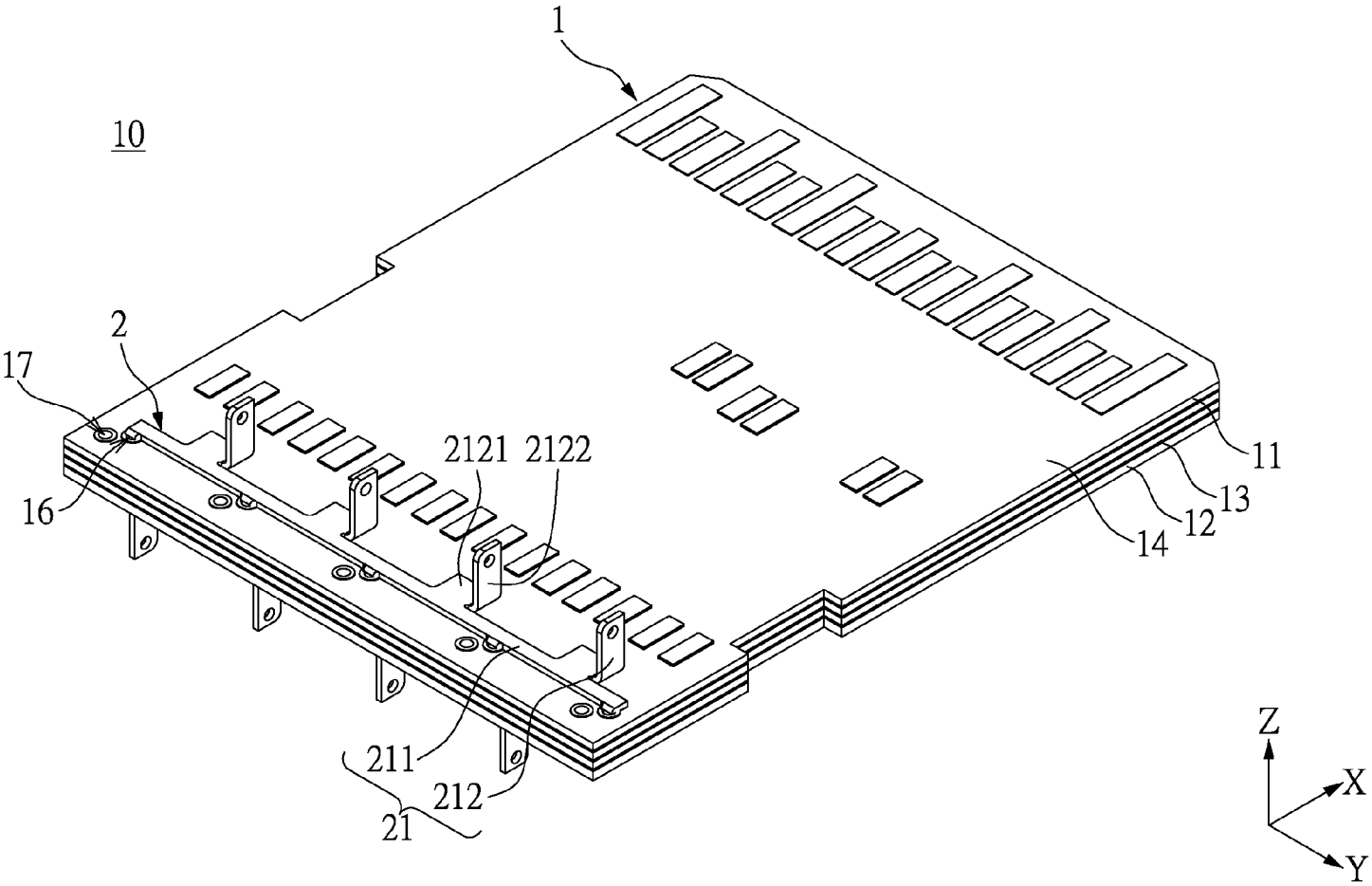
FIG. 10 is a perspective view showing a step a) of a method for assembling the cable connector according to the instant disclosure.

As shown in FIG. 10, the step a) is implemented by respectively inserting the conductive portions 22 of the two grounding bars 2 into the first holes 16 and the second holes 17 of the circuit board 1 to respectively connect to the first conductive extensions 18 (as shown in FIG. 7) and the second conductive extensions 19 (as shown in FIG. 9), and is implemented by respectively disposing the beams 211 of the grounding bars 2 on the first insulating layer 11 and the second insulating layer 12 of the circuit board 1.

Figure 11:
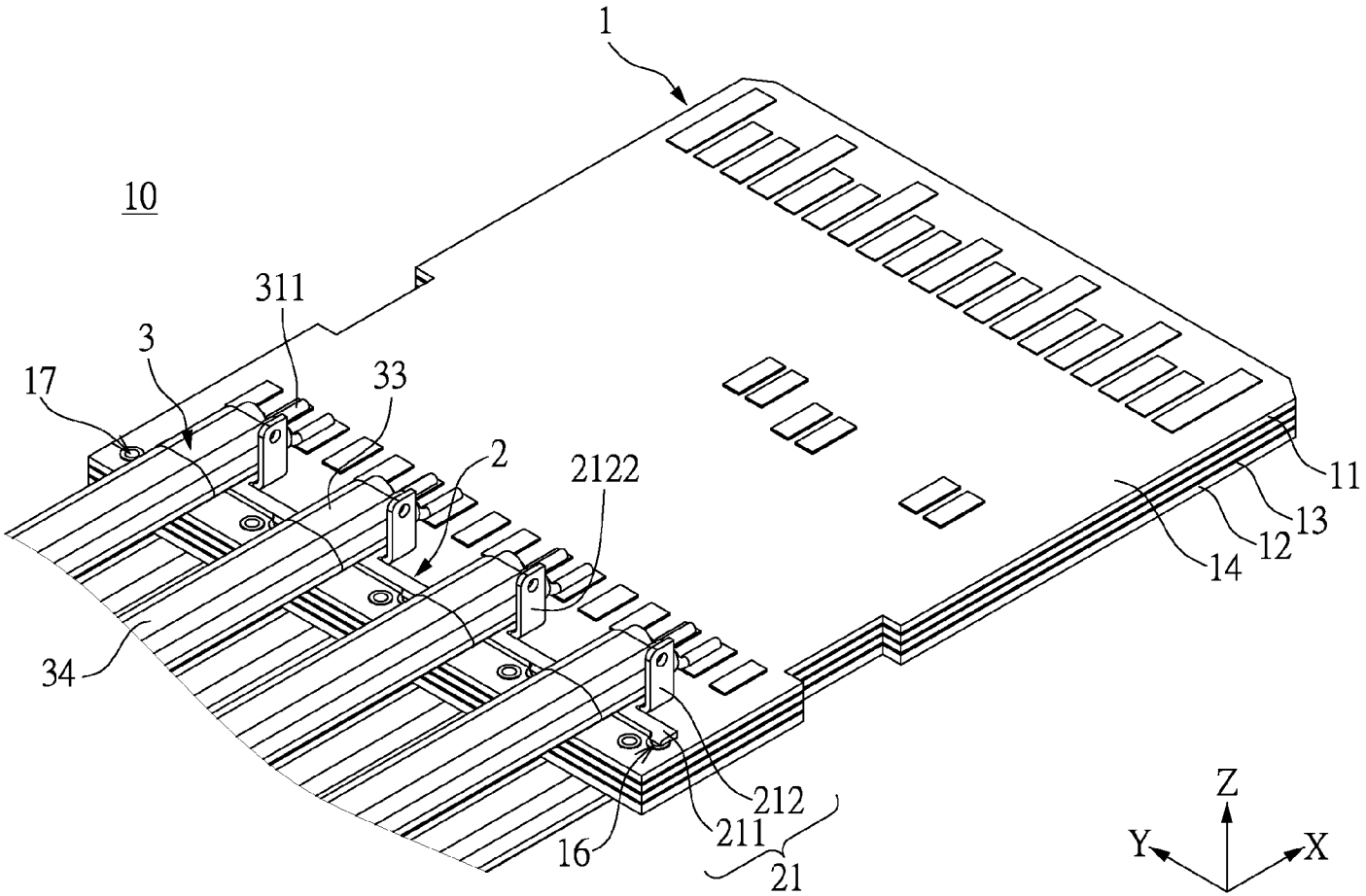
FIG. 11 is a perspective view showing steps b) and c) of the method for assembling the cable connector according to the instant disclosure.

As shown in FIG. 11, the step b) is implemented by respectively disposing the conductive cables 3 on the first surface 14 and the second surface 15 of the circuit board 1 and respectively disposing the conductive cables 3 on the two beams 211 adjacent to the corresponding positioning arms 212.

As shown in FIG. 11, the step c) is implemented by welding the exposed segments 311 of the conductive cables 3 on the first surface 14 and the second surface 15 of the circuit board 1 and disposing the metallic shielding layers 33 to respectively correspond in position to the positioning arms 212.

As shown in FIGS. 3 and 4, the step d) is implemented by fixing the positioning arms 212 respectively on the metallic shielding layers 33 of the conductive cables 3.

It should be noted that each positioning arm 212 shown in FIGS. 3 and 4 has a U shape, but each positioning arm 212 in the method has an L shape before the step a) shown in FIG. 10. Specifically, in the step a), after the conductive portions 22 of the grounding bars 2 are inserted into the circuit board 1, each positioning arm 212 having an L shape includes a first segment 2121 connected to the beam 211 and laid on the circuit board 1 and a second segment 2122 extended from one end of the first segment 2121 and perpendicular to the circuit board 1. In the step c), the exposed segments 311 of the conductive cables 3 are welded on the circuit board 1, and the metallic shielding layers 33 are respectively disposed on the first segments 2121 of the positioning arms 212. In the step d), the second segments 2122 of the positioning arms 212 are respectively bent to press on the metallic shielding layers 33, and then the pressing portions of the second segments 2122 of the positioning arms 212 are respectively welded on the metallic shielding layers 33 by a plurality of thru-holes (non-labeled) formed on the second segments 2122 of the positioning arms 212.

Accordingly, each positioning arm 212 is formed to be a U shape for clamping part of the corresponding metallic shielding layer 33. One end of each positioning arm 212 is connected to the corresponding beam 211 and is disposed on the circuit board 1, and the other end of each positioning arm 212 is preferably welded on the part of the corresponding metallic shielding layer 33.

In summary, the construction of the cable connector 100 or the method disclosed in the instant embodiment is provided by installing the grounding bars 2 on the circuit board 1 and then disposing the conductive cables 3 adjacent to the positioning arms 212 of the grounding bars 2, so that the cable connector 100 or the method disclosed in the instant embodiment can provide a better positioning effect for the conductive cables 3 compared to the conventional cable connector.

Second Embodiment

Figure 12:
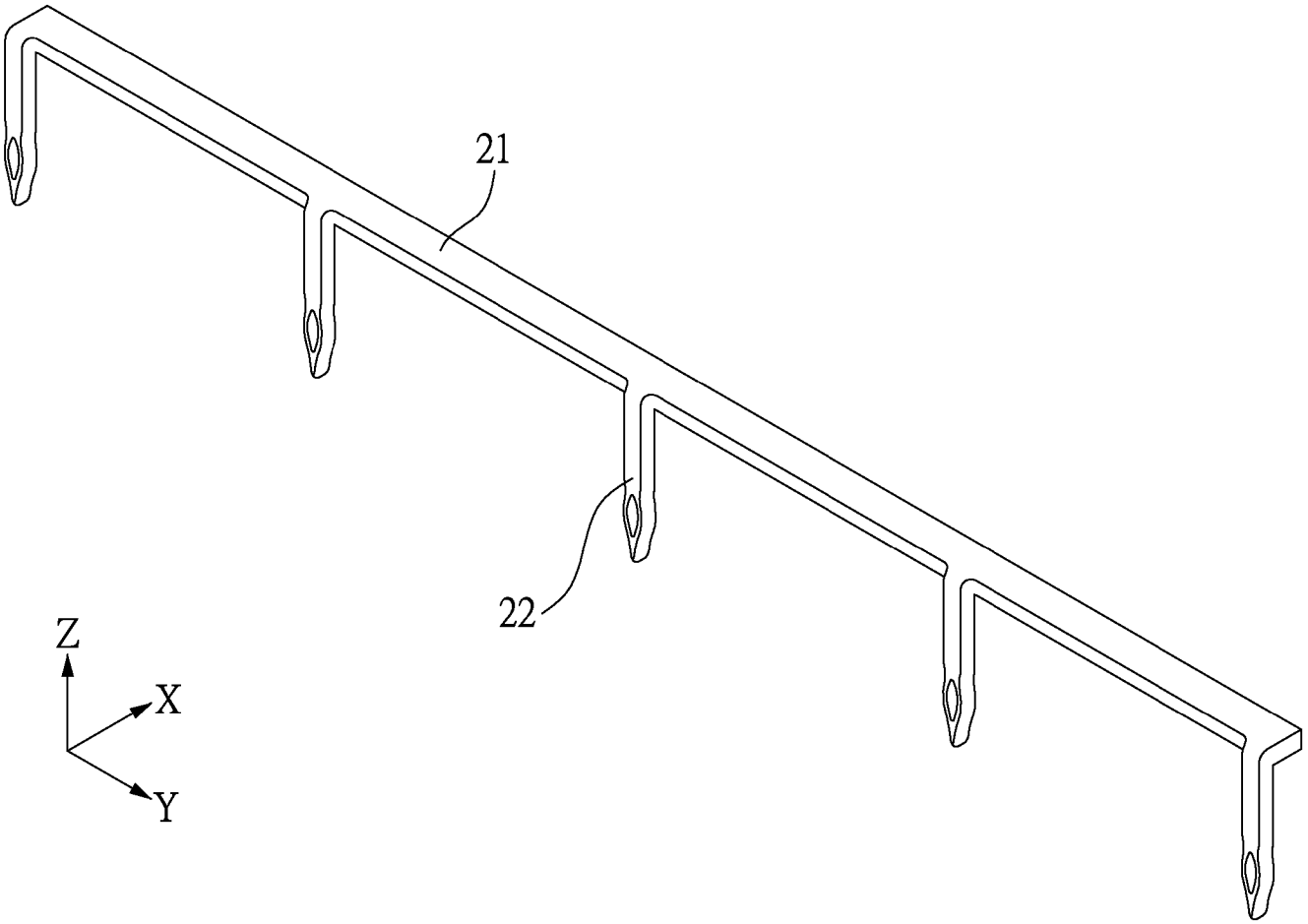
FIG. 12 is a perspective view showing a grounding bar according to a second embodiment of the instant disclosure.
Figure 13:
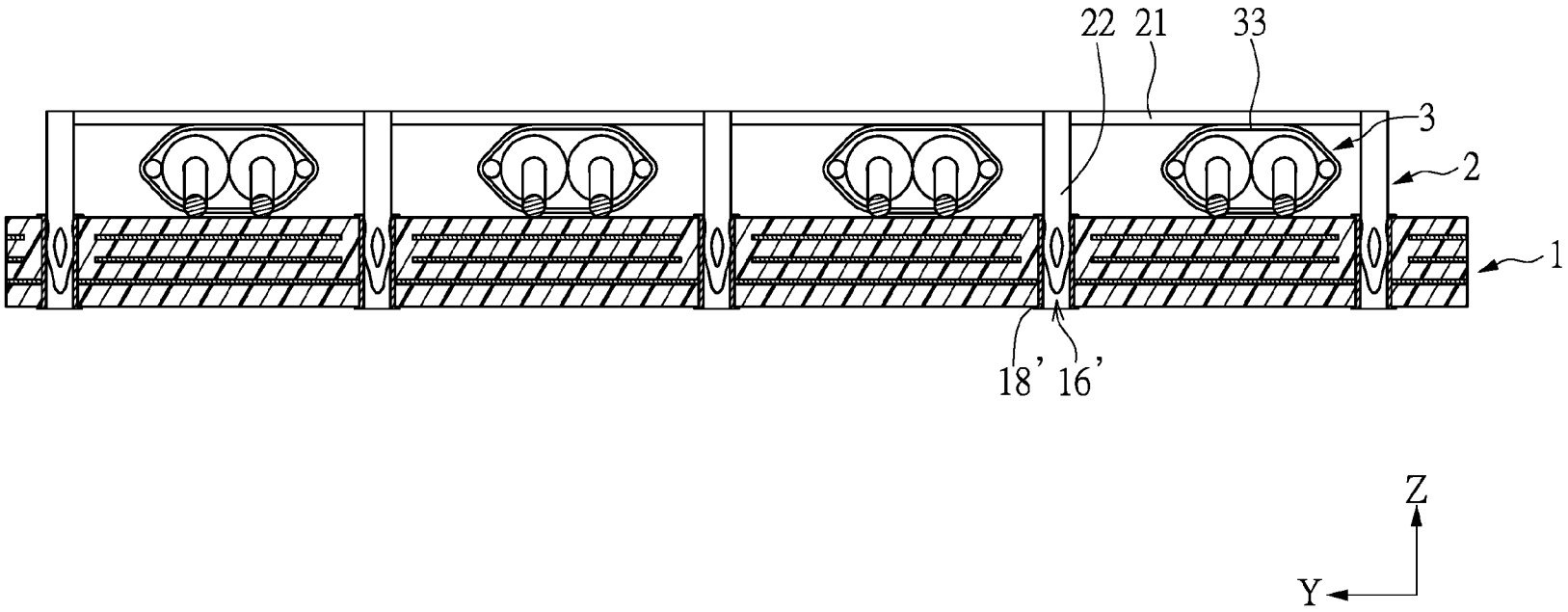
FIG. 13 is a cross-sectional view showing the cable connector of the second embodiment.

Please refer to FIGS. 12 and 13, which show a second embodiment. The second embodiment is similar to the first embodiment, the different features between the two embodiments being the construction of the grounding bar 2 and the corresponding portion of the circuit board 1.

The base portion 21 of the grounding bar 2 in the instant embodiment is an elongated structure, in other words, the base portion 21 in the instant embodiment is substantially identical to the beam 211 disclosed in the first embodiment. The conductive portions 22 of the grounding bar 2 are curvedly extended from a long edge of the base portion 21. The conductive cables 3 are disposed on the circuit board 1, and then the conductive portions 22 of the grounding bar 2 are respectively inserted into the holes 16' of the circuit board 1, so the metallic shielding layers 33 of the conductive cables 3 are clamped between the base portion 21 and the circuit board 1, thereby firmly fixing the conductive cables 3 on the circuit board 1.

Third Embodiment

Figure 14:
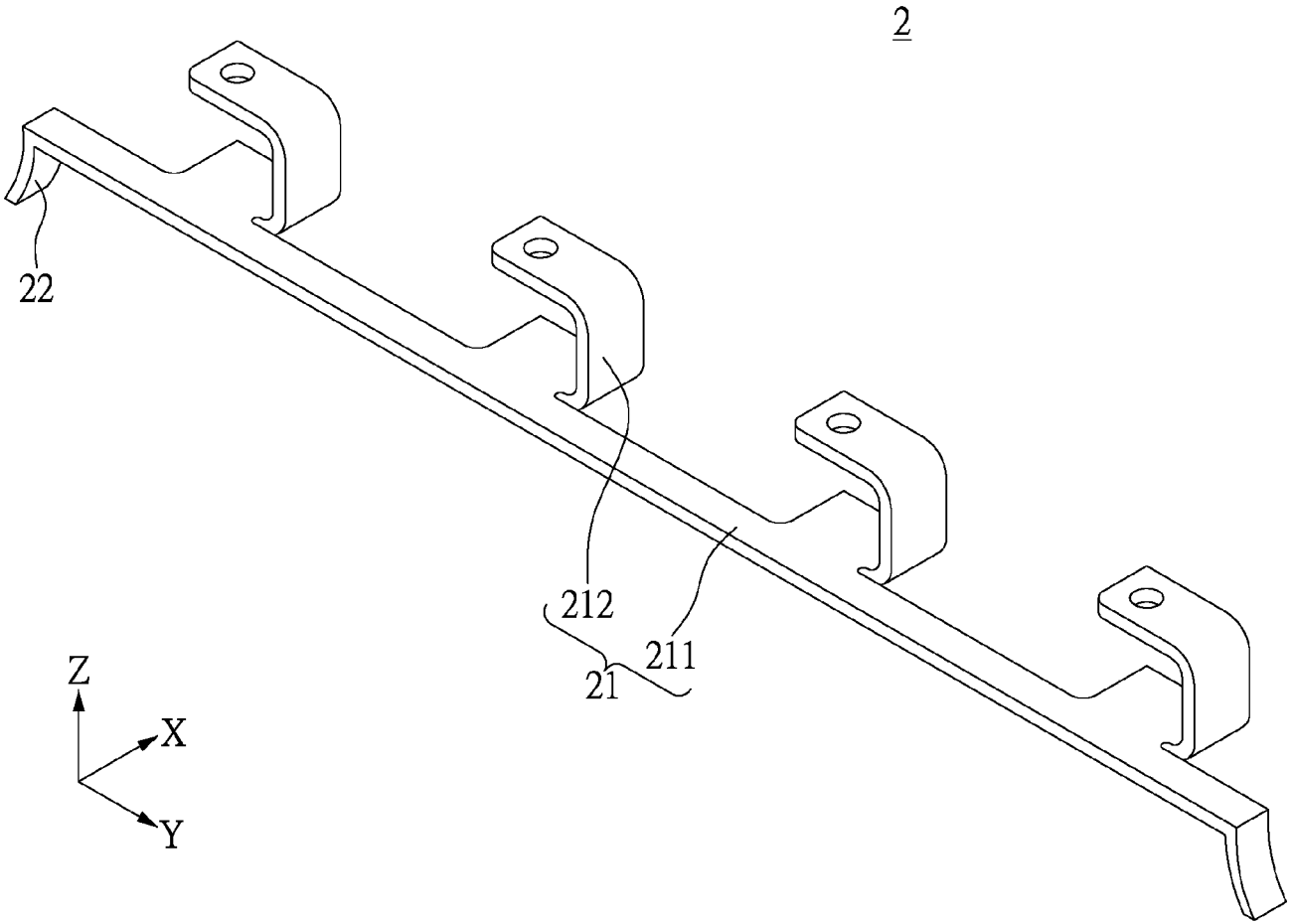
FIG. 14 is a perspective view showing a grounding bar according to a third embodiment of the instant disclosure.
Figure 15:
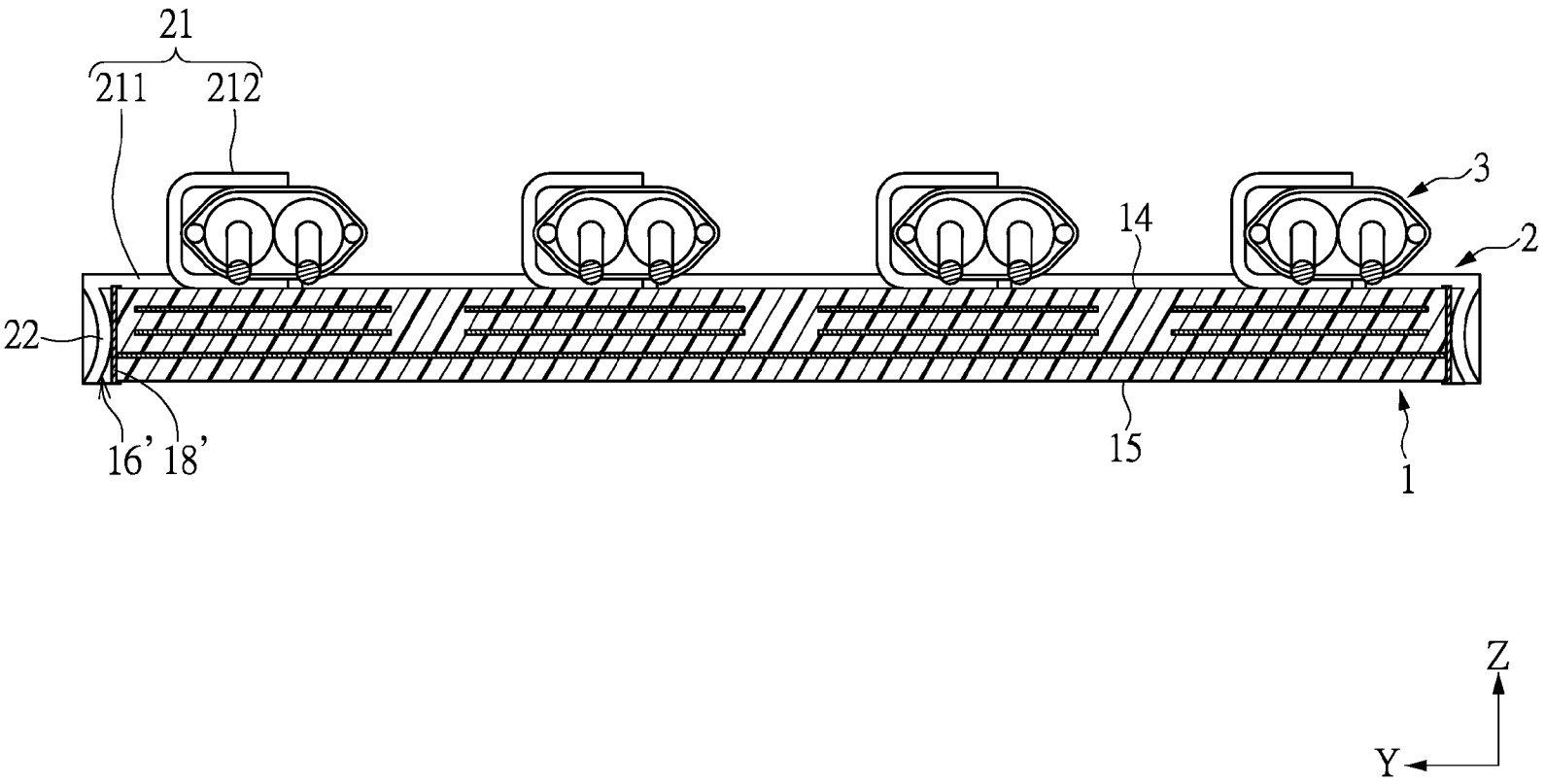
FIG. 15 is a cross-sectional view showing the cable connector of the third embodiment.

Please refer to FIGS. 14 and 15, which show a third embodiment. The third embodiment is similar to the first embodiment, the different features between the two embodiments being the construction of the grounding bar 2 and the corresponding portion of the circuit board 1.

Two holes 16' in the instant embodiment are formed on two opposite sides of the circuit board 1 (i.e., the left side and the right side of the circuit board 1 shown in FIG. 15) and penetrate the first surface 14 and the second surface 15. The circuit board 1 includes two conductive extensions 18' respectively coated on the inner walls, which define the holes 16'. The grounding bar 2 includes two elastically conductive portions 22 respectively and curvedly extended from two opposite ends of the beam 211. The two conductive portions 22 are inserted into the holes 16' and clamp the conductive extensions 18' arranged in the holes 16'.

Fourth Embodiment

Figure 16:
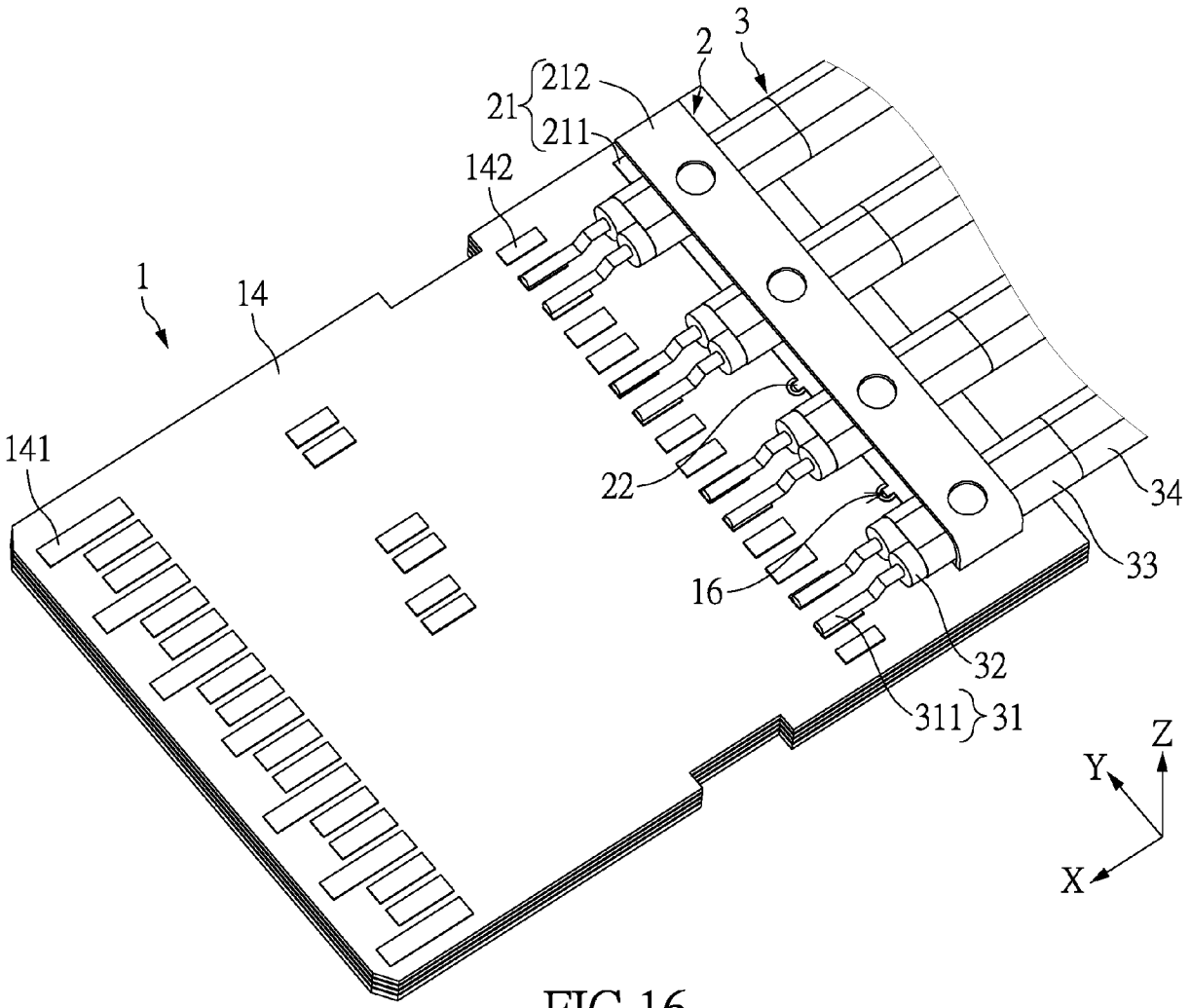
FIG. 16 is a perspective view showing a cable connector according to a fourth embodiment of the instant disclosure.
Figure 17:
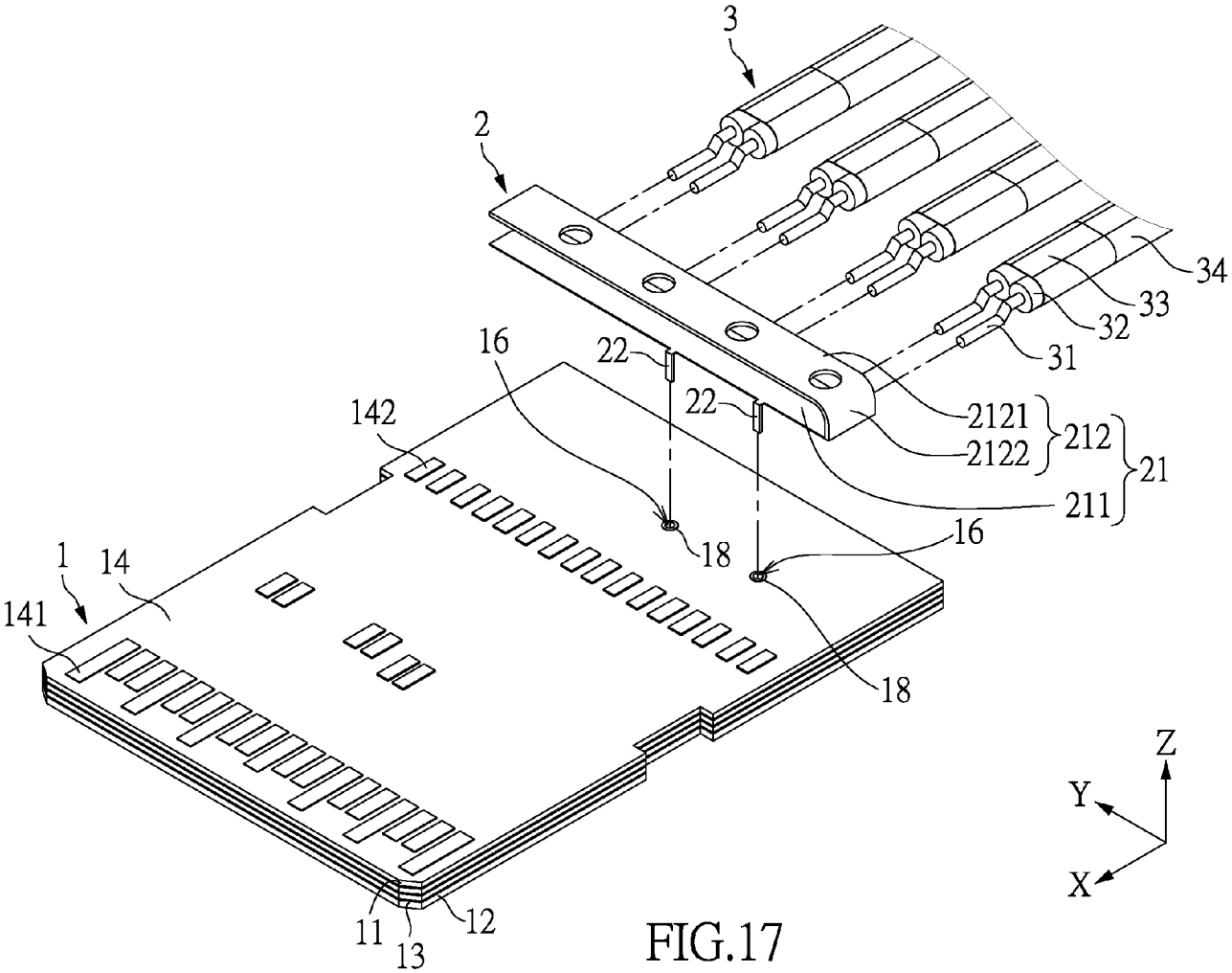
FIG. 17 is an exploded view of FIG. 16.

Please refer to FIGS. 16 and 17, which show a fourth embodiment. The fourth embodiment is similar to the first embodiment, the different features between the two embodiments being the construction of the grounding bar 2.

The base portion 21 of the grounding bar 2 in the instant embodiment having a U shape includes an elongated beam 211 and a positioning arm 212 extended from the beam 211. The conductive portions 22 of the grounding bar 2 are perpendicularly extended from a long side of the beam 211 in a direction away from the positioning arm 212. The positioning arm 212 includes a first segment 2121 parallel to the beam 211 and a second segment 2122 connecting the first segment 2121 and the beam 211. The first segment 2121 of the positioning arm 212 has a plurality of thru-holes (not labeled) respectively corresponding in position to the metallic shielding layers 33, so the metallic shielding layers 33 can be welded on the first segment 2121 of the positioning arm 212 via the thru-holes.

Moreover, the conductive portions 22 of the grounding bar 2 are respectively inserted into the holes 16 of the circuit board 1 and are respectively abutted against the conductive extensions 18. The beam 211 is disposed on the first insulating layer 11 of the circuit board 1, and the beam 211 and the positioning arm 212 clamp the metallic shielding layers 33 of the conductive cables 3.

The Possible Effect of the Instant Embodiments

In summary, each grounding bar of the cable connector (or the carrier module) in the instant disclosure is firmly fixed on the circuit board by inserting the conductive portions into the circuit board, so the connection of the circuit board and the each grounding bar can effectively resist a shearing force when any conductive cable and the circuit board are pulled. Moreover, the metallic shielding layers of the conductive cables, the grounding bars, and the grounding layer of the circuit board can establish a common-grounding loop to improve the high frequency transmitting performance of the cable connector.

In addition, the construction of the cable connector and the method disclosed installs the grounding bars on the circuit board and then disposes the conductive cables adjacent to the positioning arms of the grounding bars, so that the cable connector and the method of the instant disclosure can provide a better positioning effect for the conductive cables.

The descriptions illustrated supra set forth simply the preferred embodiments of the instant invention; however, the characteristics of the instant invention are by no means restricted thereto. All changes, alterations, or modifications conveniently considered by those skilled in the art are deemed to be encompassed within the scope of the instant invention delineated by the following claims.

What is claimed is:

1. A cable connector, comprising:

a circuit board having a first insulating layer, a second insulating layer, and a grounding layer arranged between the first insulating layer and the second insulating layer, wherein two opposite outer surfaces of the circuit board are defined as a first surface and a second surface, the circuit board has at least one hole formed on the first surface, and the circuit board has at least one conductive extension arranged in the hole and connected to the grounding layer;

a plurality of conductive cables, each comprising:

a metallic wire having an exposed segment and an embedded segment;

an isolation layer covering the embedded segment; and a metallic shielding layer covering the isolation layer, wherein the exposed segment is arranged out of the isolation layer and the metallic shielding layer, wherein the conductive cables are positioned on the first surface of the circuit board, and the exposed segments of the conductive cables are fixed on the first surface of the circuit board; and a grounding bar, comprising:

a base portion abutting against the metallic shielding layers of the conductive cables, and the metallic shielding layers are electrically connected to each other via the base portion; and at least one conductive portion connected to the base portion and inserted into the hole of the circuit board, wherein the conductive portion is connected to the conductive extension, so the grounding bar is configured to electrically connect the metallic shielding layers of the conductive cables and the grounding layer of the circuit board, wherein the base portion of the grounding bar includes a beam and a plurality of positioning arms connected to the beam, the conductive portion is connected to the beam, and the positioning arms are respectively connected to the metallic shielding layers.

2. The cable connector as claimed in claim 1, wherein each positioning arm having a U shape accommodates and clamps the corresponding metallic shielding layer, wherein an end of each positioning arm is integrally connected to the beam, and the other end of each positioning arm is welded on the corresponding metallic shielding layer.

3. The cable connector as claimed in claim 1, wherein each positioning arm includes a first segment connected to the beam and laid on the circuit board and a second segment extended from the first segment and welded on the corresponding metallic shielding layer.

4. The cable connector as claimed in claim 1, wherein the beam is disposed on the first insulating layer.

5. The cable connector as claimed in claim 1, wherein the hole is penetratingly formed from the first surface to the second surface, the conductive extension is coated on an inner wall for defining the hole, the conductive portion is configured with press-fit to compress against the conductive extension.

6. The cable connector as claimed in claim 1, wherein each of the number of the at least one hole and the number of the at least one conductive extension of the circuit board is plural, the conductive extensions are respectively arranged in the holes and are connected to the grounding layer, wherein the number of the at least one conductive portion of the grounding bar is plural, the conductive portions are respectively inserted into and positioned in the holes, the conductive portions are respectively abutted against the conductive extensions, and a portion of the beam arranged between any two adjacent conductive portions extends to form one of the positioning arms.

7. The cable connector as claimed in claim 1, wherein the grounding bar is configured without welding on any one of the first surface and the second surface of the circuit board.

8. A method for assembling the cable connector as claimed in claim 1, comprising:

a) inserting the conductive portion of the grounding bar into the hole of the circuit board to connect the conductive extension, and disposing the beam on the first insulating layer of the circuit board;

b) disposing the conductive cables on the first surface of the circuit board and the beam respectively adjacent to the positioning arms;

c) welding the exposed segments of the conductive cables on the first surface of the circuit board; and d) fixing the positioning arms respectively on the metallic shielding layers of the conductive cables.

9. The method as claimed in claim 8, wherein before the step d), each positioning arm having an L shape includes a first segment connected to the beam and laid on the circuit board and a second segment perpendicular to the circuit board; in the step c), the metallic shielding layers are respectively disposed on the first segments of the positioning arms; in the step d), the second segments of the positioning arms are respectively bent to press on the metallic shielding layers, and then the second segments of the positioning arms are respectively welded on the metallic shielding layers.

10. A carrier module of a cable connector, comprising:

a circuit board having a first insulating layer, a second insulating layer, and a grounding layer arranged between the first insulating layer and the second insulating layer, wherein two opposite outer surfaces of the circuit board are defined as a first surface and a second surface, the circuit board has at least one hole formed on the first surface, and the circuit board has at least one conductive extension arranged in the hole and connected to the grounding layer; and a grounding bar, comprising:

a base portion; and at least one conductive portion connected to the base portion and inserted into the hole of the circuit board, wherein the conductive portion is connected to the conductive extension, so the grounding bar is configured to electrically connect the grounding layer of the circuit board, wherein the base portion of the grounding bar includes a beam and a positioning arm connected to the beam, the beam is disposed on the first insulating layer of the circuit board, and the conductive portion is connected to the beam.

11. The carrier module as claimed in claim 10, wherein the positioning arm has a U shape, and an end of the positioning arm is integrally connected to the beam.

12. The carrier module as claimed in claim 11, wherein the positioning arm includes a first segment connected to the beam and laid on the first insulating layer and a second segment extended from the first segment.

13. The carrier module as claimed in claim 10, wherein the positioning arm has an L shape, and an end of the positioning arm is integrally connected to the beam.

14. The carrier module as claimed in claim 10, wherein the grounding bar is configured without welding on any one of the first surface and the second surface of the circuit board.

* * * * *